US011250758B1

(12) United States Patent
Guo et al.

(10) Patent No.: US 11,250,758 B1
(45) Date of Patent: Feb. 15, 2022

(54) GATE DRIVER CIRCUIT, DRIVING METHOD AND DISPLAY DEVICE

(71) Applicant: HKC Corporation Limited, Shenzhen (CN)

(72) Inventors: Dongsheng Guo, Shenzhen (CN); Haijiang Yuan, Shenzhen (CN); Yubo Gu, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/325,240

(22) Filed: May 20, 2021

(30) Foreign Application Priority Data

Jul. 30, 2020 (CN) ..... 202010749849.4

(51) Int. Cl.
*G09G 3/20* (2006.01)

(52) U.S. Cl.
CPC ..... *G09G 3/20* (2013.01); *G09G 2310/027* (2013.01); *G09G 2310/0278* (2013.01); *G09G 2310/0291* (2013.01); *G09G 2310/08* (2013.01)

(58) Field of Classification Search
CPC ..... G09G 3/20; G09G 2310/027; G09G 2310/0278; G09G 2310/0291; G09G 2310/08
See application file for complete search history.

(56) References Cited

U.S. PATENT DOCUMENTS

2020/0035317 A1* 1/2020 Feng ..... G11C 19/287
2020/0111421 A1* 4/2020 Kim ..... G09G 3/3266
2020/0211434 A1* 7/2020 Zhang ..... H01L 27/1259

* cited by examiner

*Primary Examiner* — Kenneth B Lee, Jr.

(57) ABSTRACT

The present application discloses a gate driver circuit, a driving method and a display device. The driving method for the gate driver circuit includes steps of receiving a first clock signal and a second clock signal and generating a plurality of first gate drive signals and a plurality of second gate drive signals based on the first clock signal and the second clock signal to drive a plurality of scanning lines, wherein the plurality of scanning lines are grouped in pairs, and the first gate drive signals and the second gate drive signals drive the two scanning lines in each group for scanning charge in a sequential or non-sequential manner; and outputting data driving signals to drive a display panel, where corresponding to the same data line, data driving signals of pixels corresponding to the same group of scanning lines have the same polarity, and data driving signals of pixels corresponding to two adjacent groups of turned-on scanning lines have opposite polarities.

20 Claims, 8 Drawing Sheets

| | | | | | | | | |
|---|---|---|---|---|---|---|---|---|
| Line 1 | + | − | + | − | + | − | + | − |
| Line 2 | − | + | − | + | − | + | − | + |
| Line 3 | + | − | + | − | + | − | + | − |
| Line 4 | − | + | − | + | − | + | − | + |
| Line 5 | + | − | + | − | + | − | + | − |
| Line 6 | − | + | − | + | − | + | − | + |

| | | | | | | | | |
|---|---|---|---|---|---|---|---|---|
| Line 1 | + | − | + | − | + | − | + | − |
| Line 2 | + | − | + | − | + | − | + | − |
| Line 3 | − | + | − | + | − | + | − | + |
| Line 4 | − | + | − | + | − | + | − | + |
| Line 5 | + | − | + | − | + | − | + | − |
| Line 6 | + | − | + | − | + | − | + | − |

| G1 \ G2 | -255 | -245 | ... | ... | -20 | -10 | 0 | 10 | ... | ... | ... | 245 | 255 |
|---|---|---|---|---|---|---|---|---|---|---|---|---|---|
| 255 | $T_{255-255}$ | $T_{255-245}$ | ... | ... | $T_{255-20}$ | $T_{255-10}$ | $T_{255-0}$ | $T_{255-10}$ | ... | ... | ... | $T_{255-245}$ | $T_{255-255}$ |
| 245 | $T_{245-255}$ | $T_{245-245}$ | ... | ... | $T_{245-20}$ | $T_{245-10}$ | $T_{245-0}$ | $T_{245-10}$ | ... | ... | ... | $T_{245-245}$ | $T_{245-255}$ |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| 10 | $T_{10-255}$ | $T_{10-245}$ | ... | ... | $T_{10-20}$ | $T_{10-10}$ | $T_{10-0}$ | $T_{10-10}$ | ... | ... | ... | $T_{10-245}$ | $T_{10-255}$ |
| 0 | $T_{0-255}$ | $T_{0-245}$ | ... | ... | $T_{0-20}$ | $T_{0-10}$ | $T_{0-0}$ | $T_{0-10}$ | ... | ... | ... | $T_{0-245}$ | $T_{0-255}$ |
| -10 | $T_{-10-255}$ | $T_{-10-245}$ | ... | ... | $T_{-10-20}$ | $T_{-10-10}$ | $T_{-10-0}$ | $T_{-10-10}$ | ... | ... | ... | $T_{-10-245}$ | $T_{-10-255}$ |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| -245 | $T_{-245-255}$ | $T_{-245-245}$ | ... | ... | $T_{-245-20}$ | $T_{-245-10}$ | $T_{-245-0}$ | $T_{-245-10}$ | ... | ... | ... | $T_{-245-245}$ | $T_{-245-255}$ |
| -255 | $T_{-255-255}$ | $T_{-255-245}$ | ... | ... | $T_{-255-20}$ | $T_{-255-10}$ | $T_{-255-0}$ | $T_{-255-10}$ | ... | ... | ... | $T_{-255-245}$ | $T_{-255-255}$ |

GATE DRIVER CIRCUIT, DRIVING METHOD AND DISPLAY DEVICE

The present application claims priority to Chinese Patent Application No. 202010749849.4, filed Jul. 30, 2020, which is hereby incorporated by reference herein as if set forth in its entirety.

TECHNICAL FIELD

The present application relates to the technical field of display, particularly to a gate driver circuit, a driving method and a display device.

BACKGROUND

The statements herein merely provide background information related to the present application and do not necessarily constitute the conventional art.

The driving of a Liquid Crystal Display (LCD) is to establish a driving electric field according to the phase, peak and frequency of different signals by adjusting applied signals, so as to realize the effect of LCD deflection display. The driving of liquid crystal is related to the magnitude of voltage, and requires inversion of positive and negative polarities to apply voltage to drive the liquid crystal. The most common polarity inversion mode is dot inversion, in which a gate driver circuit sequentially transmits gate drive signals to scanning lines on a display panel line by line from a first row to a last row and sequentially turns on switch elements of each row. In order to support the inversion of pixel electrode signals, data signals am switched from positive polarity to negative polarity or from negative polarity to positive polarity at the moment of turning on, that is, in a frame time, for a dot inversion display panel consisting of n rows of pixels, data signals of each column of data lines are switched between positive and negative polarities for n times, which causes the problem of high power consumption despite uniform display of the existing dot inversion driving mode. According to different display frames, two adjacent rows of scanning lines are driven in the same group, so that bright and dark stripes appear easily due to high step voltage. In addition, when switching from sequential scanning to non-sequential scanning, the charge time between rows with different polarities is insufficient or the charging is unsaturated due to potential difference of liquid crystal capacitors between the rows with different polarities, which easily leads to bright and dark stripes on the display panel.

How to avoid bright and dark stripes on display panels and improve the quality of displayed pictures has become an important issue in the industry since bright and dark stripes will affect the quality of pictures.

SUMMARY

The present application aims to provide a gate driver circuit, a driving method and a display device.

The present application discloses a driving method for a gate driver circuit, including steps of:

receiving a first clock signal and a second clock signal and generating a plurality of first gate drive signals and a plurality of second gate drive signals based on the first clock signal and the second clock signal to drive a plurality of scanning lines, wherein the plurality of scanning lines are grouped in pairs, and the first gate drive signals and the second gate drive signals drive the two scanning lines in each group for scanning charge in a sequential or non-sequential manner; and outputting data driving signals to drive a display panel, where corresponding to a same data line, data driving signals of pixels corresponding to the same group of scanning lines have the same polarity and data driving signals of pixels corresponding to two adjacent groups of turned-on scanning lines have opposite polarities;

where the first clock signal is a square wave signal with 2T as a period, and a high level lasts for T and a low level lasts for T within the period; the second clock signal is a square wave signal with 2T as a period, a high level lasts for T+Δt and a low level lasts for T−Δt within the period, and a falling edge of the second clock signal is at the same time as a rising edge of the first clock signal; a high level duration of the first gate drive signals is T+Δt; the first gate drive signals are output to first turned-on scanning lines in each group and the second gate drive signals are output to later turned-on scanning lines in each group.

The present application discloses a gate driver circuit, including a shift trigger and an output buffer; where the shift trigger is configured for receiving a first clock signal and a second clock signal to output gate drive signals corresponding to scanning lines in a one-to-one manner to drive a plurality of scanning lines for sequential or non-sequential scanning charge in a group of two; and the output buffer is configured for outputting the gate drive signals to respective scanning lines:

where the first clock signal is a square wave signal with 2T as a period, and a high level lasts for T and a low level lasts for T within the period; the second clock signal is a square wave signal with 2T as a period, a high level lasts for T+Δt and a low level lasts for T−Δt within the period, and a falling edge of the second clock signal is at the same time as a rising edge of the first clock signal;

the shift trigger receives the first clock signal and the second clock signal to generate a plurality of first gate drive signals and a plurality of second gate drive signals respectively, and a high level duration of the first gate drive signals is T+Δt; where the first gate drive signals are output to first turned-on scanning lines in each group and the second gate drive signals are output to later turned-on scanning lines in each group.

The present application further discloses a display device, including a display panel, a gate driver circuit and a source driver circuit, where the gate driver circuit outputs gate drive signals to drive the display panel, and the source driver circuit outputs data driving signals to drive the display panel;

where in the same frame, the gate driver circuit outputs gate drive signals corresponding to the scanning line in a one-to-one manner, and drives the scanning lines for sequential or non-sequential scanning charge in a group of two; corresponding to the same data line, data driving signals of pixels corresponding to the same group of scanning lines have the same polarity, and data driving signals of pixels corresponding to two adjacent groups of turned-on scanning lines have opposite polarities; where the gate driver circuit includes a shift trigger configured for receiving a first clock signal and a second clock signal, and an output buffer configured for outputting the gate drive signals to respective scanning lines;

the first clock signal is a square wave signal with 2T as a period, and a high level lasts for T and a low level lasts for T within the period; the second clock signal is a square wave signal with 2T as a period, a high level lasts for T+Δt and a low level lasts for T−Δt within the period, and a falling edge of the second clock signal is at the same time as a rising edge of the first clock signal;

the shift trigger receives the first clock signal and the second clock signal to generate a plurality of first gate drive signals and a plurality of second gate drive signals respectively; a high level duration of the first gate drive signals is T+Δt, and a high level duration of the second gate drive signals is T−Δt; where the first gate drive signals are output to first turned-on scanning lines in each group and the second gate drive signals are output to later turned-on scanning lines in each group.

Compared with a solution in which the power consumption is increased as data signals of each row of data lines on a dot inversion display panel consisting of n rows of pixels are switched between positive and negative polarities for n times, in the present application, the power consumption is reduced by sequential or non-sequential scanning charge of scanning lines in a group of two, where a shift trigger receives a first clock signal and a second clock signal to generate a plurality of first gate drive signals and a plurality of second gate drive signals respectively; a high level duration of the first gate drive signals is T+Δt. When charging between rows with different polarities, a time of Δt is delayed, which avoids low charging efficiency in the same time, compensates for the charging efficiency between rows with different polarities, avoids stripes due to high step voltage as the charge time is insufficient or the charging is unsaturated when switching to the next row with an opposite polarity, balances the charge time among groups of scanning lines, and improves the quality of displayed pictures.

BRIEF DESCRIPTION OF DRAWINGS

The accompanying drawings, which are included to provide a further understanding of embodiments of the present application and constitute a part of the specification, illustrate embodiments of the present application and, together with the text description, explain the principles of the present application. Obviously, the drawings in the following description are merely some embodiments of the present application, and those skilled in the art can obtain other drawings according to the drawings without any inventive labor. In the drawings.

DETAILED DESCRIPTION OF EMBODIMENTS

It should be understood that the terminology, specific structural and functional details disclosed are merely exemplary for the purpose of describing specific embodiments. However, the present application may be embodied in many alternative forms and should not be construed as being limited to the embodiments set forth herein.

In the description of the present application, the terms "first" and "second" are only for the purpose of description and cannot be construed to indicate relative importance or imply an indication of the number of technical features indicated. Therefore, unless otherwise stated, a feature defined as "first" and "second" may explicitly or implicitly include one or more of the features; "multiple" means two or more. The term "include" and any variations thereof are intended to be inclusive in a non-closed manner, that is, the presence or addition of one or more other features, integers, steps, operations, units, components and/or combinations thereof may be possible.

In addition, the terms "center", "horizontally", "up", "down", "left", "right", "vertical", "horizontal", "top", "bottom", "inner". "outer" and the like for indicating an orientation or positional relationship are based on the description of the orientation or relative positional relationship shown in the accompanying drawings, and are only simplified description facilitating description of the application, and are not intended to indicate that the device or element referred to must have a particular orientation, be configured and operated in a particular orientation, and therefore cannot be construed as limiting the present application.

In addition, unless expressly specified and defined otherwise, the terms "mount". "attach" and "connect" are to be understood broadly. For example, it can be a fixed connection, a detachable connection, or an integral connection; it can be an either mechanical connection or an electrical connection; it can be a direct connection or an indirect connection through an intermediate medium, or an internal connection between two elements. For those skilled in the art, the specific meaning of the above terms in the present application can be understood according to the specific circumstances.

The present application will now be described in details by reference to the accompanying drawings and optional embodiments.

Figure 1:
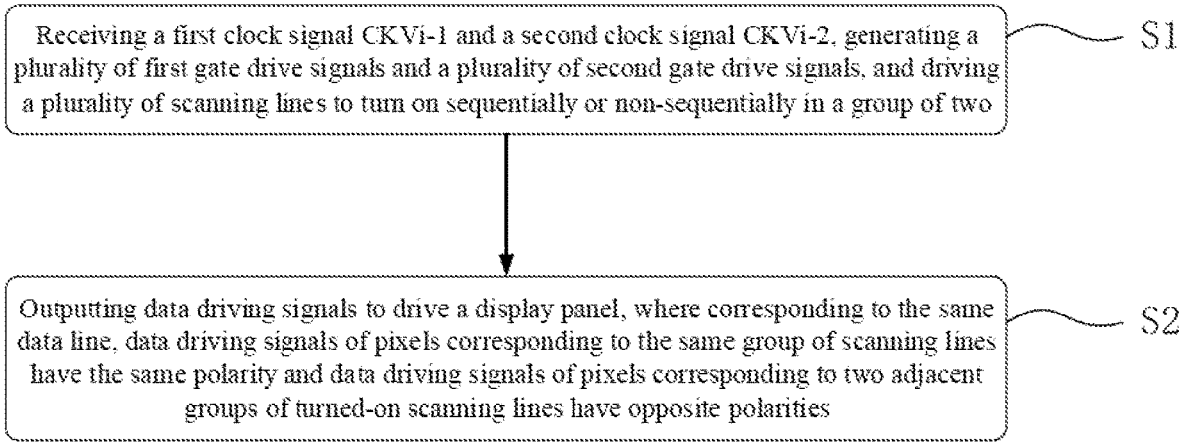
FIG. 1 is a flow diagram of a gate driver circuit according to an embodiment of the present application.

As shown in FIG. 1, as an embodiment of the present application, a driving method for a gate driver circuit is disclosed, including steps of:

S1: receiving a first clock signal CKVi-1 and a second clock signal CKVi-2, generating a plurality of first gate drive signals and a plurality of second gate drive signals, and driving a plurality of scanning lines for sequential or non-sequential scanning charge in a group of two; and S2: outputting data driving signals to drive a display panel, where corresponding to the same data line, data driving signals of pixels corresponding to the same group of scanning lines have the same polarity and data driving signals of pixels corresponding to two adjacent groups of turned-on scanning lines have opposite polarities;

where the first clock signal CKVi-1 is a square wave signal with 2T as a period, and a high level lasts for T and a low level lasts for T within the period; the second clock signal CKVi-2 is a square wave signal with 2T as a period, a high level lasts for T+Δt and a low level lasts for T−Δt within the period, and a falling edge of CKVi-2 is at the same time as a rising edge of CKVi-1; a high level duration of the first gate drive signals is T+Δt; the first gate drive signals are output to first turned-on scanning lines in each group and the second gate drive signals are output to later turned-on scanning lines in each group.

Figure 2:
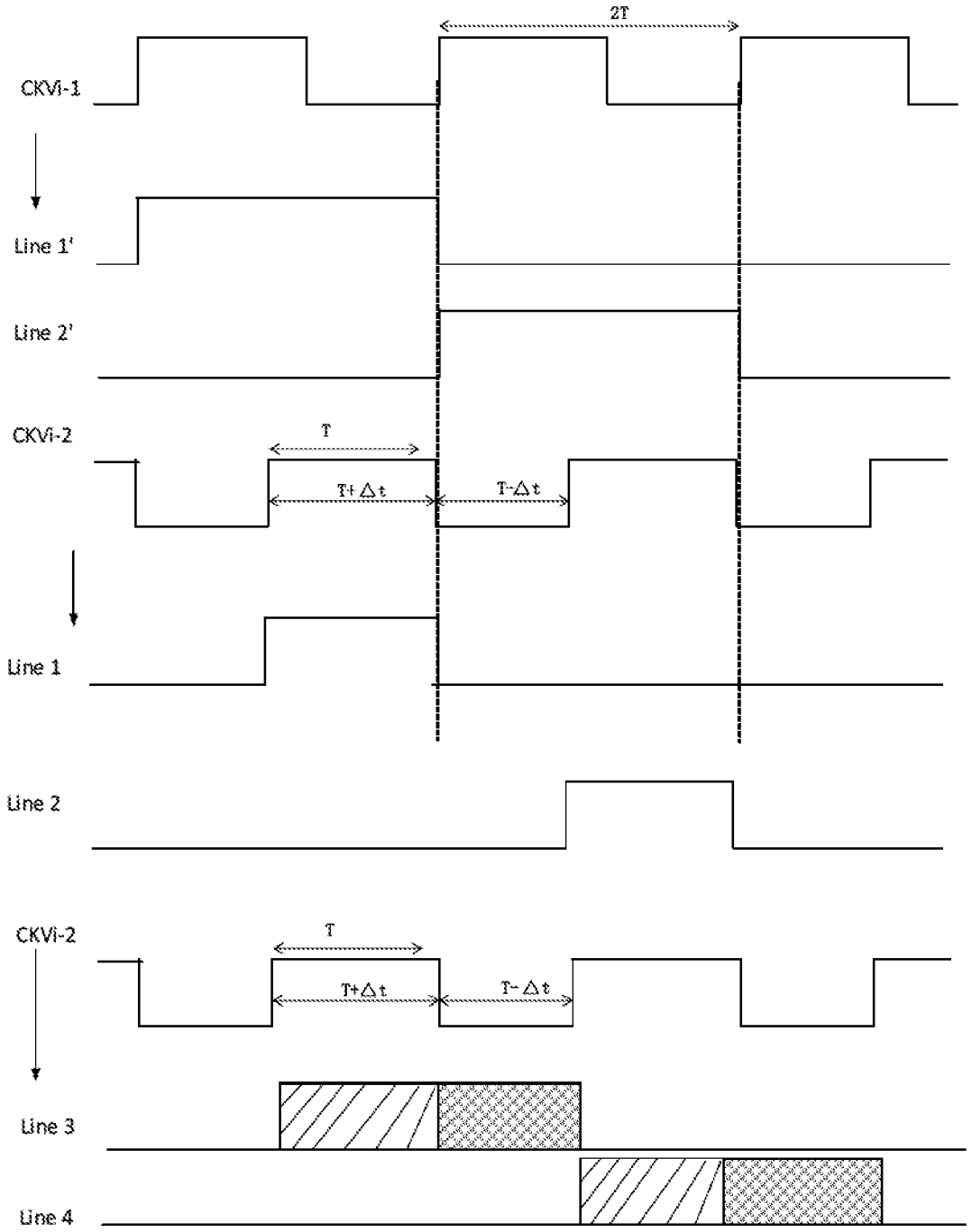
FIG. 2 is a flow diagram of a gate driver circuit according to an embodiment of the present application.

Specifically, as shown in FIG. 2, the step of receiving a first clock signal CKVi-1 and a second clock signal CKVi-2, generating a plurality of first gate drive signals and a plurality of second gate drive signals, and driving a plurality of scanning lines for sequential or non-sequential scanning charge in a group of two includes steps of:

generating first intermediate gate drive signals Line1' and second intermediate gate drive signals Line2' by the first clock signal CKVi-1:

superposing the first intermediate gate drive signals Line1' and the second clock signal CKVi-2 to generate first gate drive signals Line1 and Line2; and generating second driver signals Line3 and Line4 directly by the second clock signal CKVi-2.

Figures 3, 4:
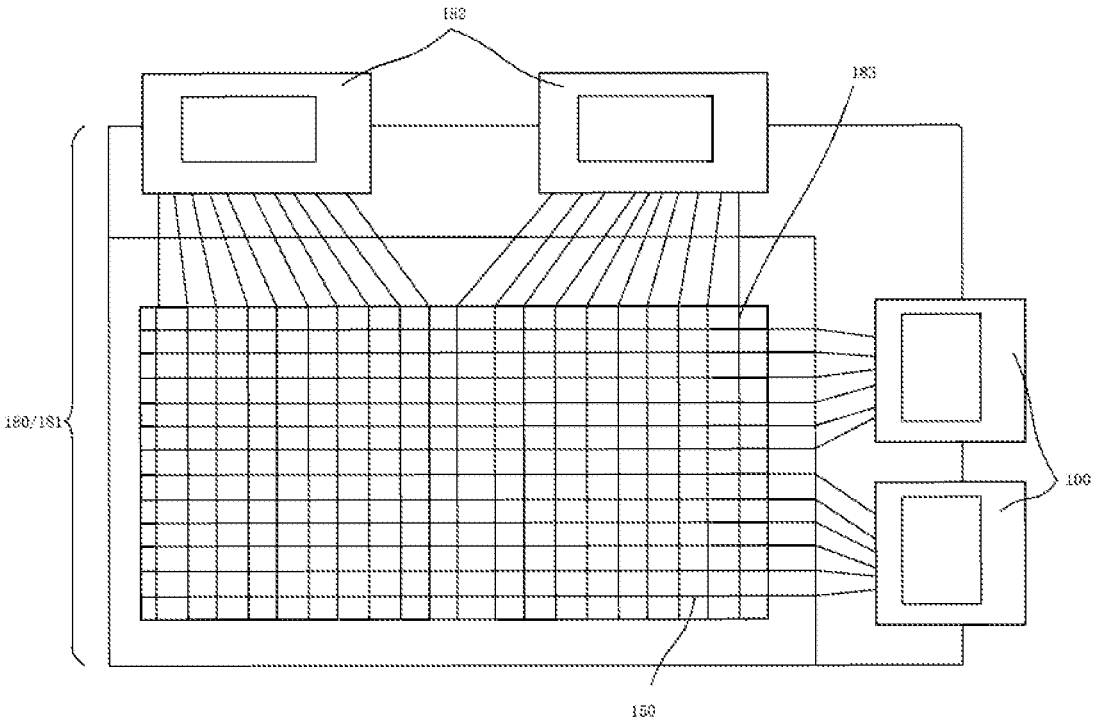
FIG. 3 is a schematic diagram of a display device according to an embodiment of the present application.
FIG. 4 is a schematic diagram of polarities according to an embodiment of the present application.

As shown in FIG. 3, as an embodiment of the present application, a display device 180 is disclosed, including a display panel 181, a gate driver circuit 100 and a source driver circuit 183; where the gate driver circuit 100 outputs gate drive signals to drive the display panel 181; and the source driver circuit 183 outputs data driving signals to drive the display panel 181; where in the same frame, the gate driver circuit 100 outputs gate drive signals corresponding to scanning lines 150 in a one-to-one manner, and drives the scanning lines 150 for sequential or non-sequential scanning charge in a group of two; corresponding to the same data line 184, data driving signals of pixels corresponding to the same group of scanning lines 150 have the same polarity, and data driving signals of pixels corresponding to two adjacent groups of turned-on scanning lines 150 have opposite polarities; specifically, as shown in FIG. 4, in the same frame, corresponding to the same data line 184, data driving signals of pixels corresponding to two adjacent rows of scanning lines 150 have opposite polarities, thereby improving the picture quality. Certainly, as shown in FIG. 5, in the same frame, corresponding to the same data line 184, with every two adjacent rows of scanning lines 150 among four adjacent rows of scanning lines 150 as a group, data driving signals of pixels corresponding to the same group of scanning lines have the same polarity, and data driving signals of pixels corresponding to two adjacent groups of scanning lines 150 have opposite polarities, so that the charging efficiency can be balanced.

Figures 5, 6:
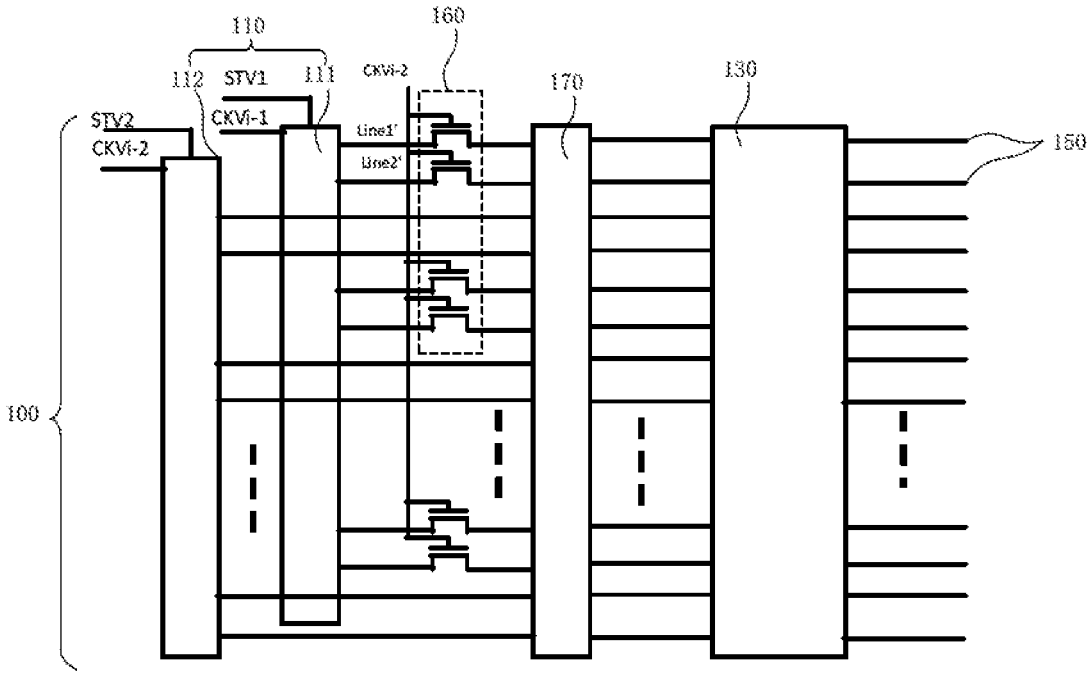
FIG. 5 is a schematic diagram of polarities according to an embodiment of the present application.
FIG. 6 is a schematic diagram of a gate driver circuit according to another embodiment of the present application.
Figure 7:
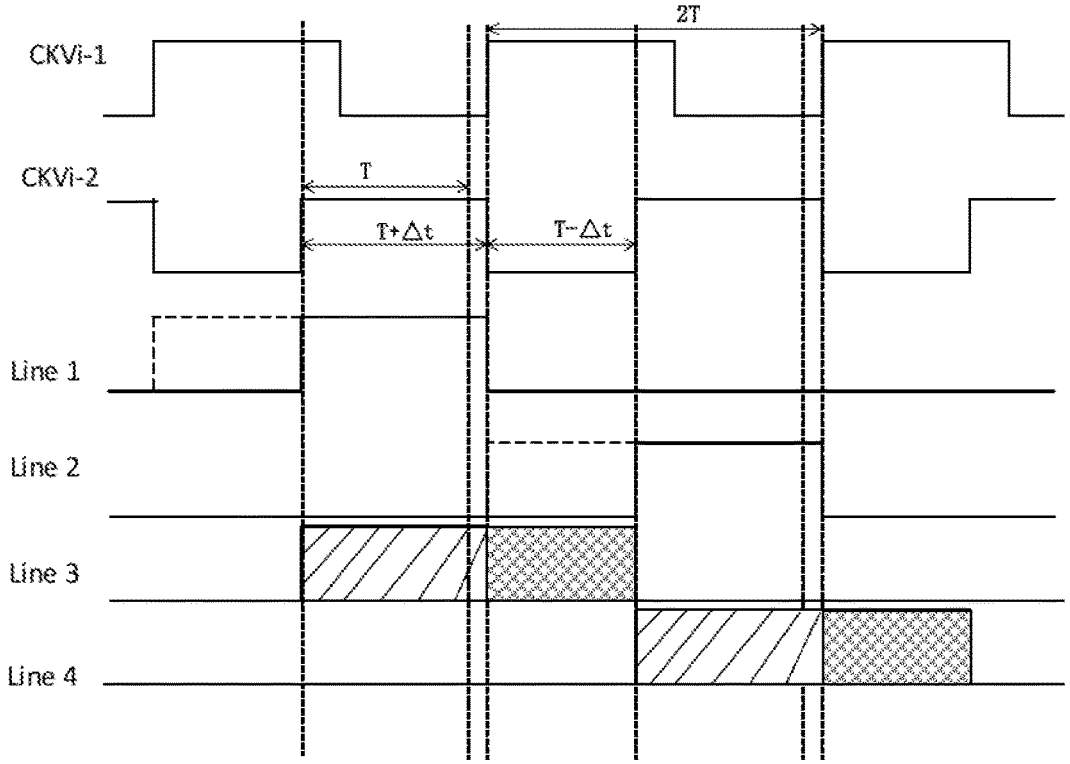
FIG. 7 is a schematic diagram of a gate driver circuit according to another embodiment of the present application.

As shown in FIGS. 6 to 7, the gate driver circuit 100 includes a shift trigger and an output buffer 130, where the shift trigger receives a first clock signal CKVi-1 and a second clock signal CKVi-2, and the output buffer 130 outputs the gate drive signals to respective scanning lines 150:

scanning pre-charge is performed on each row by the driving mode. The gate drive signals and the data driving signals are matched with each other to drive the corresponding pixels. When the gate drive signals are at a high level, the corresponding scanning lines are turned on; when a pixel is driven, not only are the gate drive signals required to be at a high level, but also the data driving signals are required to output the corresponding gray-scale value to the pixel; the scanning lines can be turned on in advance to precharge the current pixel, but the gray-scale value output by the data driving signals may be the gray-scale value of pixels in other rows that drives the pixels in other rows. Therefore, for the same panel, even though the high level duration of the second gate drive signals can be 2T, the average time for the data driving signals to drive each pixel is still T.

The first clock signal CKVi-1 is a square wave signal with 2T as a period, and a high level lasts for T and a low level lasts for T within the period; the second clock signal CKVi-2 is a square wave signal with 2T as a period, a high level lasts for T+Δt and a low level lasts for T−Δt within the period, and a falling edge of the second clock signal CKVi-2 is at the same time as a rising edge of the first clock signal CKVi-1:

the shift trigger receives the first clock signal CKVi-1 and the second clock signal CKVi-2 to generate a plurality of first gate drive signals and a plurality of second gate drive signals respectively; a high level duration of the first gate drive signals is T+Δt, and a high level duration of the second gate drive signals is T−Δt; where the first gate drive signals are output to first turned-on scanning lines 150 in each group, and the second gate drive signals are output to later turned-on scanning lines 150 in each group; specifically, the gate driver circuit 100 further includes a plurality of switch elements 160 and a potential converter 170, each output terminal of the shift trigger is connected to an input terminal of one switch element, a control terminal of the switch element 160 is connected to the second clock signal CKVi-2, an output terminal of the switch element 160 is connected to the potential converter 170, and a frame start signal is provided to the gate driver circuit 100; an output terminal of the potential converter 170 is connected to the output buffer 130.

According to different displayed pictures, the display device 180 can switch between a sequential scanning mode and a non-sequential scanning mode in frames, and stripes appear easily when charging between rows with different polarities between the sequential scanning mode and the non-sequential scanning mode. In the present application, the power consumption is reduced by sequential or non-sequential scanning charge of scanning lines 150 in a group of two, where a shift trigger receives a first clock signal CKVi-1 and a second clock signal CKVi-2 to generate a plurality of first gate drive signals and a plurality of second gate drive signals respectively; a high level duration of the first gate drive signals is T+Δt. When charging between rows with different polarities, a time of Δt is delayed, which avoids low charging efficiency in the same time, compensates for the charging efficiency between rows with different polarities, and avoids stripes due to high step voltage as the charge time is insufficient or the charging is unsaturated when switching to the next row with an opposite polarity. The first gate drive signals are output to scanning lines 150 in each group, so that there is an additional time of Δt for charging, and the second gate drive signals are output to later turned-on scanning lines 150 in each group to increase the initial voltage of the first turned-on scanning lines 150, and balance the charge time among groups of scanning lines 150, thereby making the charging of the later turned-on scanning lines 150 more saturated, and improving the quality of displayed pictures.

Figure 8:
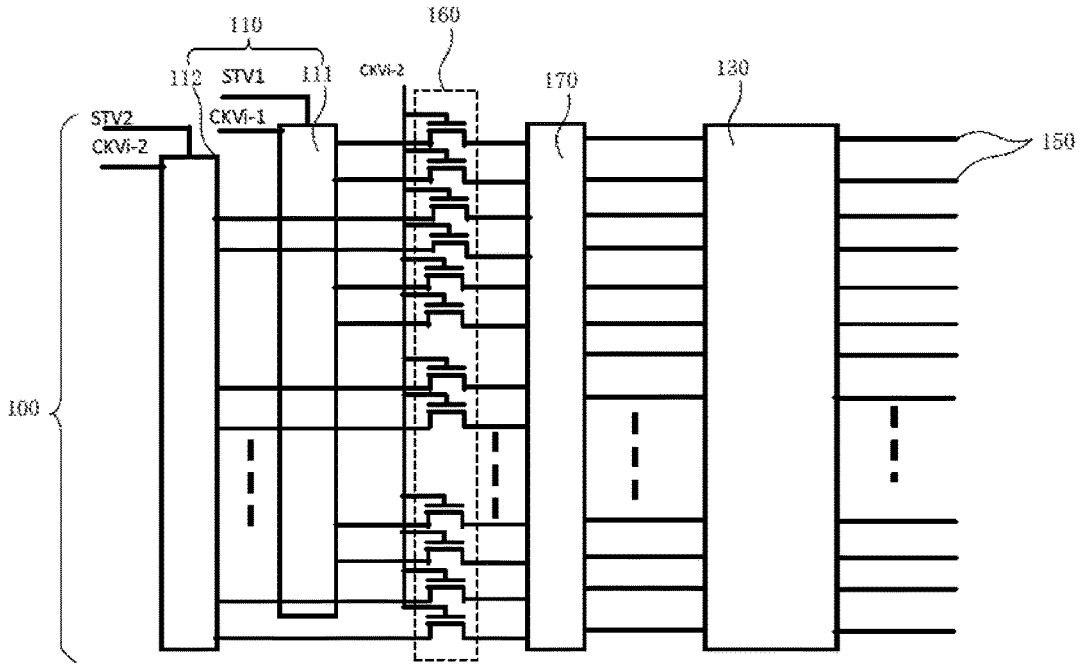
FIG. 8 is a diagram of a gate driver circuit according to another embodiment of the present application.
Figures 9, 10:
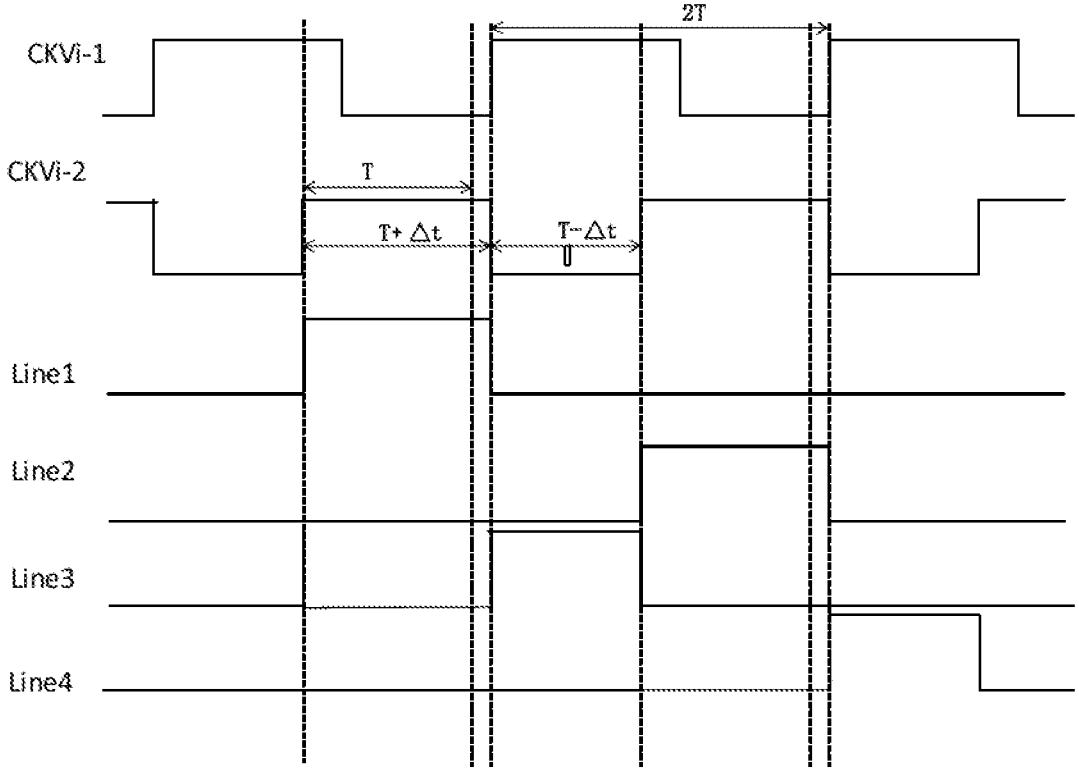
FIG. 9 is a diagram of a gate driver circuit according to another embodiment of the present application.
FIG. 10 is a schematic diagram of a table according to another embodiment of the present application.

Specifically, the high level duration of the second gate drive signals is 2T. Under the combined action of the signal CKVi-1 and the signal CKVi-2, the output signal of the scanning lines is off by the output enable action of the CKVi-2 at a section where the rising edge of the CKVi-1 corresponds to the falling edge of the CKVi-2, so that the scanning lines 150 are not charged in the section where the output signal is off when the high level signal CKVi-1 is superposed with the low level signal CKVi-2 in turned-on scanning lines 150 of line1 and line2. For CKVi-1, the scanning lines 150 of the line1 or the line2 which are turned on first in each group of scanning lines are charged within the time from the rising edge of the CKVi-2 to the next rising edge of the CKVi-1, and meanwhile, the scanning lines 150 of line 3 and line 4 which are turned on later are simultaneously precharged due to the action of the CKVi-2. After the next rising edge of the CKVi-1 is turned on, the scanning charge for the scanning lines 150 of the line1 and the line2 which are turned on first is completed, and the scanning lines 150 of the line 3 and the line 4 which are turned on later are further charged on the basis of the precharging under the action of the CKVi-2 until the next rising edge of the CKVi-2 is turned on; in this way, the scanning pre-charge of each row is completed by the driving mode. Certainly, as shown in FIGS. 8 to 9, the high level duration of the second gate drive signals is T−Δt, and the display quality can be improved by balancing the charge time of the first turned-on scanning lines 150 without pre-charge. At this time, each output terminal of the first shift trigger 111 and the second shift trigger 112 is connected to an input terminal of one switch element 160, the second clock signal CKVi-2 controls a control terminal connected to the switch element 160, an output terminal of the switch element 160 is connected to the potential converter 170, and an output terminal of the potential converter 170 is connected to an input terminal of the output buffer 130.

Figure 11:
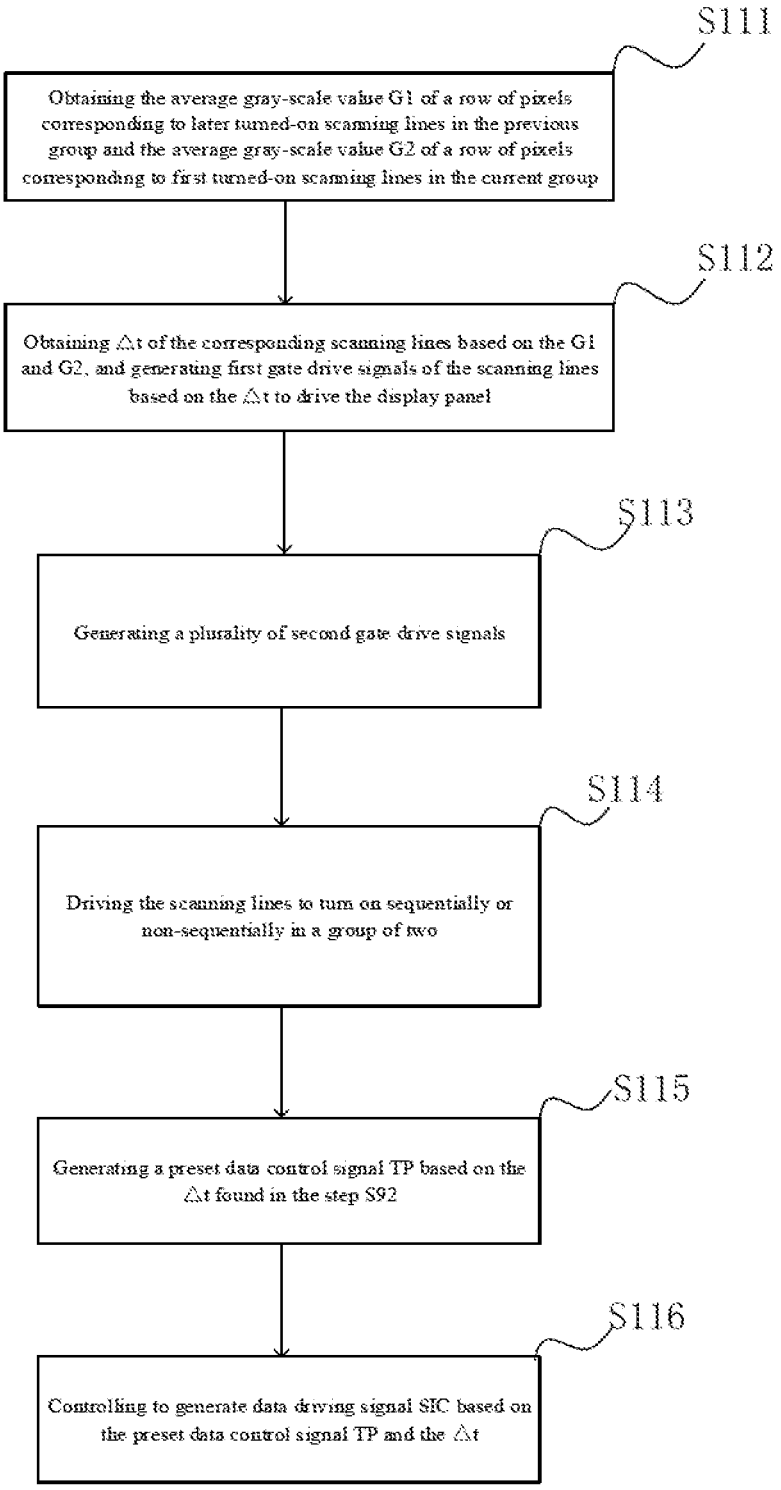
FIG. 11 is a flowchart for looking up a table according to another embodiment of the present application.

Certainly, the Δt can be obtained quickly by looking up the table. With reference to FIG. 10, the average gray-scale value G1 of a row of pixels corresponding to later turned-on scanning lines in the previous group of the current frame and the average gray-scale value G2 of a row of pixels corresponding to first turned-on scanning lines in the current group are acquired and calculated. With the obtained values of G1 and G2 as parameters, the Δt of the corresponding scanning lines is obtained by looking up a preset compensation time table. The Δt of the corresponding scanning lines is obtained according to the G1 and G2, and first gate drive signals of the scanning lines are generated according to the Δt to drive the display panel. When Δt=0, it means no adjustment, no compensation signal, and normal scanning switch. As shown in FIG. 11, a driving method for a display panel is provided, including steps of:

S111: obtaining the average gray-scale value G1 of a row of pixels corresponding to later turned-on scanning lines in the previous group and the average gray-scale value G2 of a row of pixels corresponding to first turned-on scanning lines in the current group:

S112: obtaining Δt of the corresponding scanning lines based on the G1 and G2, and generating first gate drive signals of the scanning lines based on the Δt to drive the display panel;

S113: generating a plurality of second gate drive signals;

S114: driving the scanning lines to turn on sequentially or non-sequentially in a group of two;

S115: generating a preset data control signal TP based on the Δt found in the step S92; and S116: controlling to generate data driving signal SIC based on the preset data control signal TP and the Δt.

It should be noted that the first gate drive signals and the second gate drive signals are generated by a gate driver chip and synchronously output to each scanning line without priority.

Specifically, the shift trigger includes a first shift trigger 111 and a second shift trigger 112, where the output of the first shift trigger 111 is turned on first, and the output of the second shift trigger 112 is turned on later, and the gate driver circuit includes a potential converter 170, where each output terminal of the second shift trigger 112 is connected to the potential converter 170, and a frame start signal is connected to the gate driver circuit 100. In addition, as shown in FIG. 6, the gate driver circuit may also include a plurality of switch elements 160, where each output terminal of the second shift trigger 112 is connected to an input terminal of a switch element, a control terminal of the switch element 160 is connected to the second clock signal CKVi-2, and an output terminal of the switch element 160 is connected to the potential converter 170.

Figure 12:
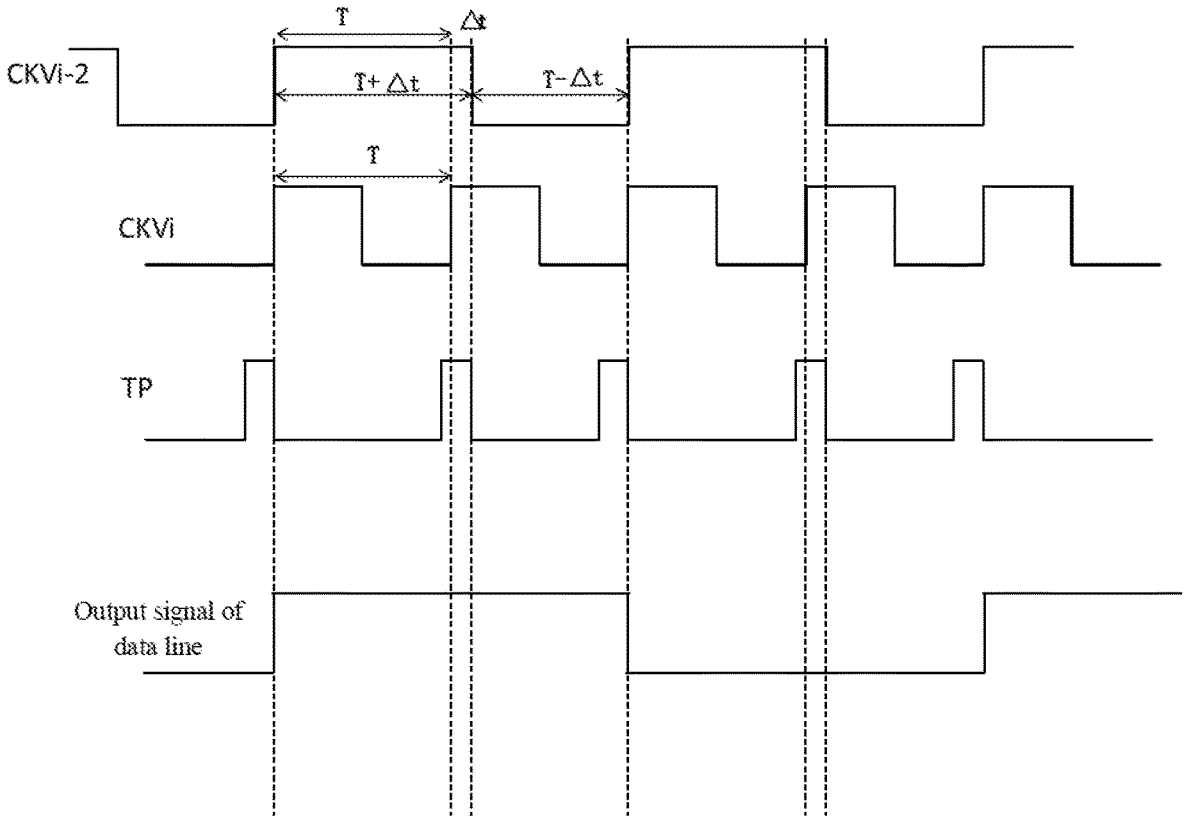
FIG. 12 is a schematic diagram of source electrode driving according to another embodiment of the present application.

As shown in FIG. 12, the source driver circuit 183 receives the second clock signal CKVi-2 and generates corresponding data driving signals, where the data voltage duration of the data driving signals when the first gate drive signals are on is longer than the data voltage duration of the data driving signals when the second gate drive signals are on. Specifically, the data voltage duration of the data driving signals when the first gate drive signals are on is T+Δt, and the data voltage duration of the data driving signals when the second gate drive signals are on is T−Δt.

It should be noted that, the limitation of the steps involved in this solution, without affecting the implementation of the specific solution, is not determined to limit the sequence of steps, and the previous steps may be executed first, later, or even simultaneously. Any sequence shall be deemed to fall within the scope of the present application as long as the solution can be implemented.

The technical solution of the present application can be applied to a wide variety of display panels, such as Twisted Nematic (TN) display panels, In-Plane Switching (IPS) display panels, Vertical Alignment (VA) display panels. Multi-domain Vertical Alignment (MVA) display panels, and other types of display panels, such as Organic Light-Emitting Diode (OLED) display panels.

The above content is a further detailed description of the present application in conjunction with specific optional embodiments, and it is not to be construed that specific embodiments of the present application are limited to these descriptions. For those of ordinary skill in the art to which the present application belongs, a number of simple derivations or substitutions may be made without departing from the spirit of the present application, all of which shall be deemed to fall within the scope of the present application.

What is claimed is:

1. A driving method for a gate driver circuit, comprising steps of:

receiving a first clock signal and a second clock signal and generating a plurality of first gate drive signals and a plurality of second gate drive signals based on the first clock signal and the second clock signal to drive a plurality of scanning lines, wherein the plurality of scanning lines are grouped in pairs, and the first gate drive signals and the second gate drive signals drive the two scanning lines in each group for scanning charge in a sequential or non-sequential manner; and outputting data driving signals to drive a display panel, wherein corresponding to a same data line, data driving signals of pixels corresponding to the same group of scanning lines have the same polarity and data driving signals of pixels corresponding to two adjacent groups of turned-on scanning lines have opposite polarities;

wherein the first clock signal is a square wave signal with 2T as a period, and a high level lasts for T and a low level lasts for T within the period; the second clock signal is a square wave signal with 2T as a period, a high level lasts for T+Δt and a low level lasts for T−Δt within the period, and a falling edge of the second clock signal is at the same time as a rising edge of the first clock signal; a high level duration of the first gate drive signals is T+Δt; the first gate drive signals are output to first turned-on scanning lines in each group and the second gate drive signals are output to later turned-on scanning lines in each group; the T is equal to an average time for the data driving signals to drive each pixel, and the Δt is equal to a time for compensating the first gate drive signals.

2. The driving method for a gate driver circuit according to claim 1, wherein the step of receiving a first clock signal and a second clock signal and generating a plurality of first gate drive signals and a plurality of second gate drive signals based on the first clock signal and the second clock signal to drive a plurality of scanning lines comprises steps of:

generating first intermediate gate drive signals and second intermediate gate drive signals by the first clock signal;

superposing the first intermediate gate drive signals and the second clock signal to generate first gate drive signals; and generating second driver signals directly by the second clock signal.

3. A gate driver circuit configured for driving a plurality of scanning lines, comprising:

a shift trigger configured for receiving a first clock signal and a second clock signal, outputting gate drive signals corresponding to scanning lines in a one-to-one manner to drive the plurality of scanning lines for sequential or non-sequential scanning charge in a group of two; and an output buffer configured for outputting the gate drive signals to respective scanning lines;

wherein the first clock signal is a square wave signal with 2T as a period, and a high level lasts for T and a low level lasts for T within the period;

the second clock signal is a square wave signal with 2T as a period, a high level lasts for T+Δt and a low level lasts for T−Δt within the period, and a falling edge of the second clock signal is at the same time as a rising edge of the first clock signal;

the shift trigger receives the first clock signal and the second clock signal to generate a plurality of first gate drive signals and a plurality of second gate drive signals respectively, and a high level duration of the first gate drive signals is T+Δt;

the first gate drive signals are output to first turned-on scanning lines in each group, and the second gate drive signals are output to later turned-on scanning lines in each group;

wherein the T is equal to an average time for the data driving signals to drive each pixel, and the Δt is equal to a time for compensating the first gate drive signals.

4. The gate driver circuit according to claim 3, wherein a high level duration of the second gate drive signals is 2T.

5. The gate driver circuit according to claim 3, wherein a high level duration of the second gate drive signals is T−Δt.

6. The gate driver circuit according to claim 3, wherein a high level duration of the second gate drive signals comprises a pre-charge time and a charge time; the pre-charge time is T+Δt, and the charge time is T−Δt.

7. The gate driver circuit according to claim 3, wherein the gate driver circuit comprises a plurality of switch elements and a potential converter, each output terminal of the shift trigger is connected to an input terminal of one switch element, the second clock signal is in control connection with a control terminal of the switch element, an output terminal of the switch element is connected to the potential converter, and an output terminal of the potential converter is connected to an input terminal of the output buffer.

8. The gate driver circuit according to claim 3, wherein the shift trigger comprises a first shift trigger and a second shift trigger, the output of the first shift trigger is turned on first, and the output of the second shift trigger is turned on later; the gate driver circuit comprises a plurality of switch elements and a potential converter, and each output terminal of the first shift trigger and the second shift trigger is connected to an input terminal of one switch element; the second clock signal is in control connection with a control terminal of the switch element, and an output terminal of the switch element is connected to the potential converter; an output terminal of the potential converter is connected to an input terminal of the output buffer.

9. The gate driver circuit according to claim 3, wherein the shift trigger comprises a first shift trigger and a second shift trigger, the output of the first shift trigger is turned on first, and the output of the second shift trigger is turned on later; the gate driver circuit further comprises a plurality of switch elements and a potential converter, each output terminal of the second shift trigger is connected to an input terminal of one switch element, a control terminal of the switch element inputs the second clock signal, and an output terminal of the switch element is connected to the potential converter; an output terminal of the first shift trigger is directly connected to the potential converter; an output terminal of the potential converter is connected to an input terminal of the output buffer.

10. The gate driver circuit according to claim 3, wherein in the same frame, corresponding to the same data line, data driving signals of pixels corresponding to two adjacent rows of scanning lines have opposite polarities.

11. The gate driver circuit according to claim 3, wherein in the same frame, corresponding to the same data line, with every two adjacent rows of scanning lines among four adjacent rows of scanning lines as a group, data driving signals of pixels corresponding to the same group of scanning lines have the same polarity, and data driving signals of pixels corresponding to two adjacent groups of scanning lines have opposite polarities.

12. A display device, comprising:

a display panel;

a gate driver circuit configured for outputting gate drive signals to drive the display panel; and a source driver circuit configured for outputting data driving signals to drive the display panel;

wherein in the same frame, the gate driver circuit outputs gate drive signals corresponding to scanning lines in a one-to-one manner, and drives the scanning lines for sequential or non-sequential scanning charge in a group of two; corresponding to a same data line, data driving signals of pixels corresponding to the same group of scanning lines have the same polarity, and data driving signals of pixels corresponding to two adjacent groups of turned-on scanning lines have opposite polarities;

wherein the gate driver circuit includes:

a shift trigger configured for receiving a first clock signal and a second clock signal; and an output buffer configured for outputting the gate drive signals to respective scanning lines;

wherein the first clock signal is a square wave signal with 2T as a period, and a high level lasts for T and a low level lasts for T within the period;

the second clock signal is a square wave signal with 2T as a period, a high level lasts for T+Δt and a low level lasts for T−Δt within the period, and a falling edge of the second clock signal is at the same time as a rising edge of the first clock signal;

the shift trigger receives the first clock signal and the second clock signal to generate a plurality of first gate drive signals and a plurality of second gate drive signals respectively, and a high level duration of the first gate drive signals is T+Δt;

the first gate drive signals are output to first turned-on scanning lines in each group, and the second gate drive signals are output to later turned-on scanning lines in each group;

wherein the T is equal to an average time for the data driving signals to drive each pixel, and the Δt is equal to a time for compensating the first gate drive signals.

13. The display device according claim 12, wherein in the same frame, corresponding to the same data line, data driving signals of pixels corresponding to two adjacent groups of scanning lines have opposite polarities.

14. The display device according to claim 12, wherein the data voltage duration of the data driving signals when the first gate drive signals are on is T+Δt, and the data voltage duration of the data driving signals when the second gate drive signals are on is T−Δt.

15. The display device according to claim 12, wherein a high level duration of the second gate drive signals is 2T.

16. The display device according to claim 12, wherein a high level duration of the second gate drive signals comprises a pre-charge time and a charge time; the pre-charge time is T+Δt, and the charge time is T−Δt.

17. The display device according to claim 12, wherein a high level duration of the second gate drive signals is T−Δt.

18. The gate driver circuit according to claim 12, wherein the shift trigger comprises a first shift trigger and a second shift trigger, the output of the first shift trigger is turned on first, and the output of the second shift trigger is turned on later; the gate driver circuit further comprises a plurality of switch elements and a potential converter, each output terminal of the second shift trigger is connected to an input terminal of one switch element, a control terminal of the switch element inputs the second clock signal, and an output terminal of the switch element is connected to the potential converter; an output terminal of the first shift trigger is directly connected to the potential converter; an output terminal of the potential converter is connected to an input terminal of the output buffer.

19. The display device according claim 12, wherein in the same frame, corresponding to the same data line, data driving signals of pixels corresponding to two adjacent rows of scanning lines have opposite polarities.

20. The display device according to claim 12, wherein in the same frame, corresponding to the same data line, with every two adjacent rows of scanning lines among four adjacent rows of scanning lines as a group, data driving signals of pixels corresponding to the same group of scanning lines have the same polarity, and data driving signals of pixels corresponding to two adjacent groups of scanning lines have opposite polarities.

* * * * *